United States Patent [19]

Ishibashi

[11] Patent Number: 5,005,473

[45] Date of Patent: Apr. 9, 1991

[54] PRESS ROLL ELEVATOR IN A DOUBLE FACER

[75] Inventor: Yoshimitsu Ishibashi, Hiroshima, Japan

[73] Assignee: Mitsubishi Jukogyo Kabushiki Kaisha, Tokyo, Japan

[21] Appl. No.: 410,271

[22] Filed: Sep. 21, 1989

[30] Foreign Application Priority Data

Sep. 26, 1988 [JP] Japan ..... 63-124667[U]

[51] Int. Cl.[5] ..... B30B 5/04

[52] U.S. Cl. ..... 100/154; 100/151; 100/93 RP; 156/470; 156/583.5

[58] Field of Search ..... 100/151, 154, 118, 93 RP, 100/153; 156/583.5, 555, 470, 548, 580; 425/367, 373, 363

[56] References Cited

U.S. PATENT DOCUMENTS

| | | | |
|---|---|---|---|
| 2,254,860 | 9/1941 | Rose | 100/153 X |
| 2,508,216 | 5/1950 | Bonds et al. | 100/151 |
| 3,459,122 | 8/1969 | Pastoors et al. | 100/118 |
| 3,607,523 | 9/1971 | McGirr | 156/470 X |
| 3,668,786 | 6/1972 | Barny | 100/153 X |
| 3,676,268 | 7/1972 | Brandenburg et al. | 100/154 X |
| 3,709,650 | 1/1973 | Gutoski et al. | 100/153 X |
| 3,753,838 | 8/1973 | Brandenburg | 100/154 X |
| 3,829,338 | 8/1974 | Hayasi et al. | 156/583.5 X |
| 4,042,446 | 8/1977 | Lawton | 156/470 X |
| 4,202,721 | 5/1980 | Roberts | 156/583.5 X |

FOREIGN PATENT DOCUMENTS

| | | |
|---|---|---|
| 1912085 | 11/1970 | Fed. Rep. of Germany . |
| 2056466 | 5/1971 | France . |
| 1046813 | 10/1966 | United Kingdom . |

*Primary Examiner*—Harvey C. Hornsby
*Assistant Examiner*—Stephen F. Gerrity
*Attorney, Agent, or Firm*—Rothwell, Figg, Ernst & Kurz

[57] ABSTRACT

A press roll elevator in a double facer is disclosed including press roll groups each having a plurality of press rolls for a corrugated cardboard sheet traveling in a first direction through the double facer. The press rolls are rotatably supported between tip end portions of respective pairs of arms which swing in the sheet's direction of travel about fulcrum shafts mounted on both side frames of the double facer. The fulcrum shafts are disposed at intervals along the sheet's direction of travel, and the press rolls are elevated and lowered by swing motion of the respective pairs of arms. Common rails reciprocated along the sheet's direction of travel and having protrusions extending therefrom abut against the respective arms causing the swing motion. The protrusions are disposed along the common rails at protrusion intervals and differences between the fulcrum intervals between the respective fulcrum shafts and the protrusion intervals are successively varied in the sheet's direction of travel, thereby facilitating adjustment and other maintenance for the press roll elevator.

3 Claims, 4 Drawing Sheets

PRESS ROLL ELEVATOR IN A DOUBLE FACER

BACKGROUND OF THE INVENTION

1. Field of the Invention

The present invention relates to an elevator for press rolls disposed in a heating part or the like of a double facer in a corrugate machine.

1. Description of Background Art

In a heretofore known double facer of the above-described type, as shown in FIG. 4(A), a single-faced corrugated cardboard sheet a having starch applied to its flute tips by means of a glue machine 1 (See FIG. 5) and a liner b which is preliminarily heated by a preheater 2 (See FIG. 5) enter the machine and are laminated. In a heating part 10A sheets a and b are conveyed and pinched between a heating box 4 on the lower side and a canvas belt 3 on the upper side (3*a* denoting a drive pulley). In a cooling part 10*b*, they are conveyed and pinched between the canvas belt 3 on the upper side and a conveyor belt 5 stretched between pulleys 5a and 5b. Pressing forces are applied to sheets a and b from the upper side via the canvas belt 3 by a large number of press rolls 9 which are disposed as spaced in the direction of travel and cause the sheets and ascend and descend. In the heating part 10*a*, the heat from heating boxes 4 cause the starch to gel resulting in a bonded and joined double-faced corrugated cardboard sheet a, b. After the corrugated cardboard sheet has cooled and regulated in nature (correction of warp deformation or the like) in the cooling part 10*b*, it travels to the next step of the process.

As further illustrated in FIG. 4(B), press rolls 9 are rotatably supported between connecting shafts 25 via bearings 23*a*, connecting shafts 25 are supported by air cylinders 21 at the top of the both side frames 10 of the double facer by the intermediary of yokes 22, pins 23 and bearings 24, thereby there is provided a press roll elevator in which the press rolls 9 are elevated and lowered. The corrugated cardboard sheets are pressed via the canvas belt 3 by the respective press roll 9 disposed at an interval in the traveling direction of the sheets. The pressing forces are useful for promoting the heating in the heating part 10*a* and also for facilitating conveying the sheet by increasing a frictional force between the canvas belt 3 and the corrugated cardboard sheet. It is necessary to set an appropriate pressing force such that it does not crush the flute tips, and with regard to the strength required for the pressing force, it is necessary to make the strength adapted to the conditions such as a manufacturing speed of the double-faced corrugated cardboard sheet a, b (a sheet traveling velocity), specifications (material and paper sheet thickness) of the raw material paper sheets for the corrugated cardboard sheet, types and combinations of flutes of the corrugated cardboard sheet, working environment (room temperature or the like).

The above-described press roll elevator shown in FIGS. 4(A) and 4(B) is constructed to elevate press rolls 9 by feeding pressurized air into a pair of air cylinders 21 provided for each press roll 9 thereby making the press roll inactive. On the other hand, the air cylinders 21 are made to be inactive for allowing the rolls 9 to descend due to their own weight and thereby applying the above-mentioned pressing force. A characteristic feature of the elevator is that a number of operative press rolls 9 can be selectively preset for adjusting overdrying or insufficient heating of the sheet which varies depending upon various conditions such as specifications of the sheet, machine speeds and the like.

In a further embodiment shown in FIGS. 5(A) and 5(B), press rolls are rotatably supported in a heating part 10*a* between top end portions of respective pairs of arms 12 which are pivotably supported from the both side frames 10. The press rolls 9 are disposed at an interval in the traveling direction of the sheet, and respective protrusions 16 on rails 15 which are reciprocated along the traveling direction of the sheet are held in contact with the lower portions of the respective arms 12 to swing the arms 12. Rails 15 are reciprocated by means of geared motors or the like via wheels, screw shafts 17, and the like, hence the respective press rolls 9 are synchronously raised as a whole by the reciprocating motion of the respective rails 15 and descend due to their own weights thereby applying pressing forces to the sheet. In addition, cooling part 10*b* includes respective arms which are disposed so as to be swingable about fulcrum shafts on both side frames 10 and the respective press rolls attached to the ends of the arms are actuated to ascend and descend through a mechanism similar to that described above. Further, the thicknesses of the single-faced corrugated cardboard sheet a and the liner b are detected in cooling part 10*b* which produces a detection signal representative thereof. The above-described rails 15 are controlled in response to that detection signal, thus the pressing forces of the respective press rolls 9 are adjusted as a whole, and the gap distance between the canvas belt 3 and the heating box 4 can be appropriately adjusted depending upon the thickness of the corrugated cardboard sheet.

In the prior art example shown in FIGS. 4(A) and 4(B), the adjustment for individually elevating and lowering the respective press rolls while holding them in parallel to the top surface of the heating box is difficult because the both ends of the respective press rolls are elevated and lowered by actuating the respective air cylinders. In some cases, the press rolls would descend at an inclined state and would partly crush the flute tips of the corrugated cardboard sheet. As a counter-measure for preventing such accident, it is necessary to additionally provide a sheet flute crush preventing device, such as stoppers for the press rolls, which can be adjusted in correspondence to the thickness or the like of the corrugated cardboard sheet. Also, a large number of air cylinders and electromagnetic valves for control purpose are necessitated, which increases the likelihood of troubles such as seizure of a coil in the electromagnetic valve or faulty operations caused by dust or the like entered into the piping. Furthermore, pneumatic machines such as compressors or the like and various relevant equipment such as air pipings or the like become necessary resulting in a more complicated and expensive structure.

In the example of the prior art shown in FIG. 5, since the respective arms for supporting the respective press rolls are disposed on the upper side as well as on the lower side of the corrugated cardboard sheet, and also since the respective arms and the respective press rolls are synchronously elevated and lowered as a whole at the same time, it is impossible to adjustably control the pressing forces in correspondence to the conditions (traveling speed, sheet thickness, etc.) of the corrugated cardboard sheet. Also, difficulties would accompany the work of removing starch dregs sticking to the upper surface of the heating box and cleaning the surface, and so, there exists the problem that the work takes too much time and the rate of operation (productivity) of the machine is lowered.

SUMMARY OF THE INVENTION

The present invention has been developed in order to deal with the above-mentioned problems in the prior art, and one object of the present invention is to provide an improved press roll elevator in a double facer, in which horizontality of the respective press rolls is assured. Also, the respective press rolls in a press roll group are elevated and lowered in successively different phases, thereby adjusting the pressing forces and a workability for inspection and maintenance. In addition, sticking performance and reliability are improved, and rate of operation as well as a productivity are raised.

According to one feature of the present invention, there is provided a press roll elevator including press roll groups each having press rolls for engaging a corrugated cardboard sheet which are rotatably supported between tip end portions of respective pairs of arms which are adapted to swing in the traveling direction of the sheet about fulcrum shafts on the both side frames of the double facer. According to the invention, the press rolls are disposed at intervals along the traveling direction of the sheet, and the above-mentioned press rolls are elevated and lowered by swing motion of the aforementioned arms the construction is characterized in that common rails are adapted to be reciprocated along the traveling direction of the sheet and are provided with protrusions which butt against the aforementioned respective arms to swing them. Differences between the fulcrum intervals between the above-mentioned respective fulcrum shafts and the protrusion intervals between the corresponding protrusions are successively varied in the traveling direction of the sheet, whereby the respective press rolls can be elevated and lowered while maintaining their horizontality by swinging the respective arms with the respective protrusions on the common rails reciprocating in the sheet's direction of travel. In addition, the elevated positions of the respective press rolls are successively varied resulting from the differences between the fulcrum intervals between the respective fulcrum shafts and the protrusion intervals between the corresponding protrusions are successively varied in the traveling direction of the sheet, thus facilitating adjustment of the pressing forces. Also, the works of inspection, maintenance and the like are facilitated as well.

According to the present invention, as a result of the reciprocating motion of the common rails, the respective arms abut against the respective protrusions on the common rails and thereby cause them to swing. Thus, the respective press rolls are actuated to be elevated and lowered can rise and fall while being held horizontally owing to the synchronous swinging of the respective pairs of arms at the opposite end portions of the respective press rolls caused by the above-mentioned protrusions. Hence, the pressing forces applied to the sheet are equalized along the width direction of the sheet. Furthermore, the respective press rolls in the press roll group are subjected to successively varied elevating and lowering operation resulting from the differences between the fulcrum intervals between the respective fulcrum shafts and the protrusion intervals between the corresponding protrusions are successively varied in the sheet's direction of travel. Thus, the pressing forces applied by the press roll group can be adjusted, and dealing with trouble such as a damaged liner sheet, removing starch dregs and the like, can be achieved easily and quickly.

The above-mentioned and other objects, features and advantages of the present invention will become more apparent by reference to the following description of preferred embodiments of the invention taken in conjunction with the accompanying drawings.

DESCRIPTION OF THE PREFERRED EMBODIMENTS

Figure 1A:
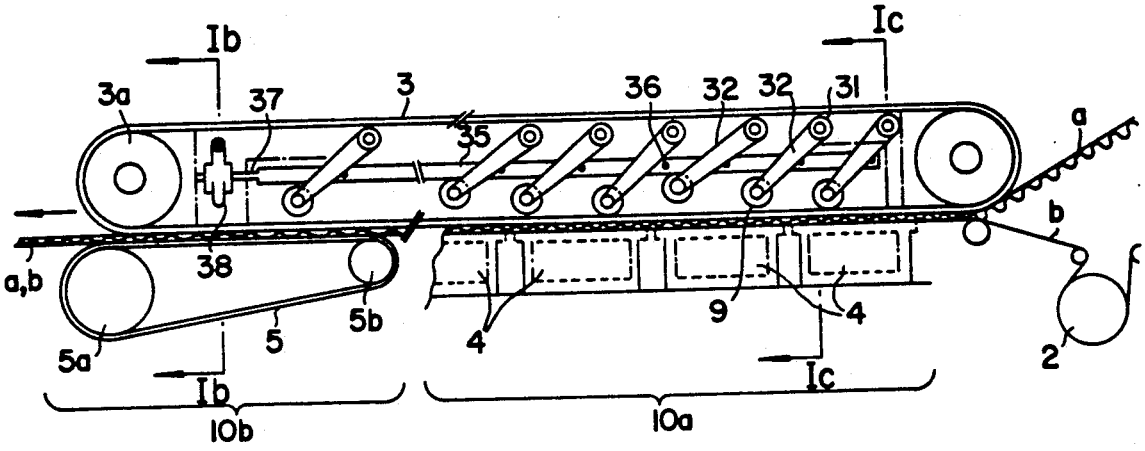
FIG. 1(A) is a side view showing a first preferred embodiment of the present invention.
Figure 1B:
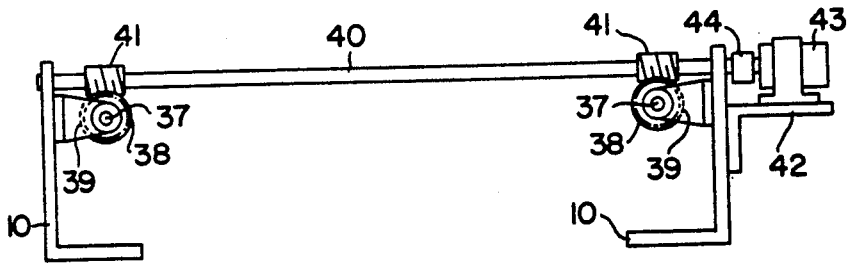
FIG. 1(B) is a cross-section view taken along line Ib—Ib in FIG. 1(A)
Figure 2A:
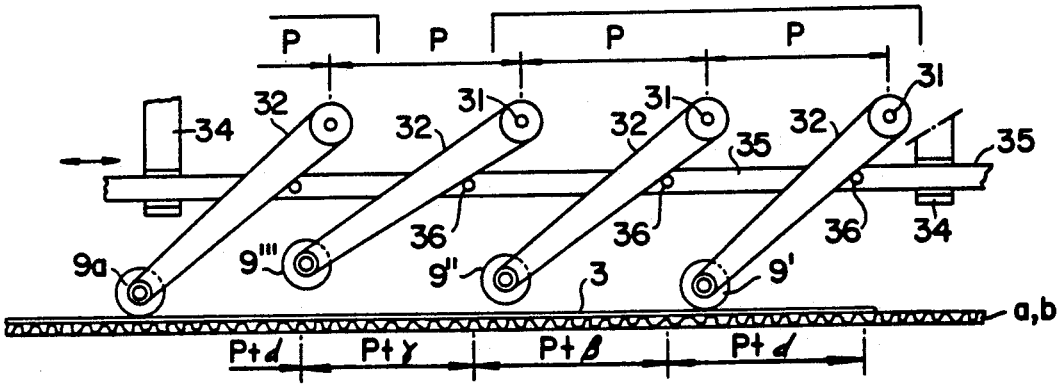
FIG. 2(A) is an enlarged side view of the portion of a press roll group in FIG. 1(A)
Figure 2B:
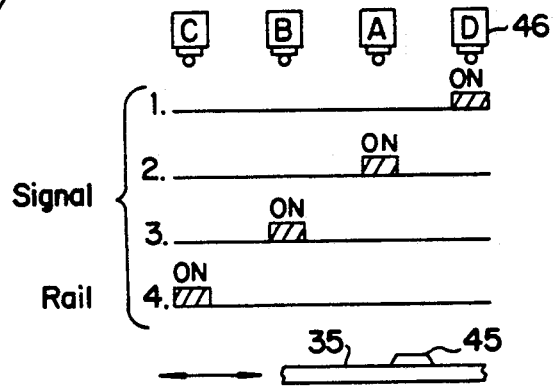
FIG. 2(B) is a schematic view showing a position control mechanism on the common rail in FIG. 2(A)

Referring now to FIGS. 1(A) and 1(B) and 2(A) and 2(B) which illustrate a first preferred embodiment of the present invention, reference character a designates a single-faced corrugated cardboard sheet having starch applied to its flute tips and character b designates a liner, that has been preliminarily heated by a preheater 2. Numeral 3 designates a canvas belt disposed on the upper side of a heating part 10*a* and a cooling part 10*b* which is driven by a drive pulley 3a. Numeral 4 designates a plurality of heating boxes disposed on the lower side of the heating part 10*a* and numeral 5 designates a conveyor belt disposed on the lower side of the cooling part 10*b* which is driven by pulleys 5a and 5b. In the illustrated press roll elevator in a double facer, there are provided press roll groups, each having press rolls 9 rotatably supported between lower portions of respective pairs of arms 32 adapted to swing in the traveling direction of the sheet about fulcrum shafts 31 at the upper portions of both side frames 10 of the double facer. Press rolls 9 are disposed at intervals in the traveling direction of the sheet, and are elevated and lowered by swing motion of the arms 32. Furthermore, there are provided common rails 35 adapted to be reciprocated along the traveling direction of the sheet and comprise protrusions 36 projecting therefrom which abut against swing respective arms 32. As illustrated in FIGS. 2(A) and 2(B), the fulcrum intervals between the respective fulcrum shafts 31 and the respective protrusion intervals $(p+\alpha)$, $(p+\beta)$ and $(p+\gamma)$ are relatively varied to establish different pitches which are successively varied in the traveling direction of the sheet.

Figure 1C:
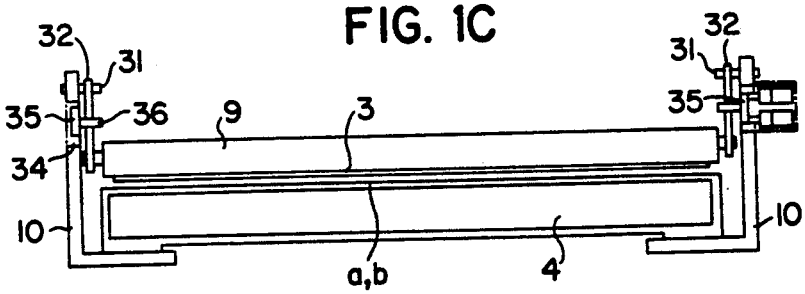
FIG. 1(C) is a cross-section view taken along line Ic—Ic in FIG. 1(A)

As shown in FIGS. 1(A) and 1(C), the above-mentioned common rails 35 are disposed on both side frames 10 on the respective sides of the double facer to be reciprocated in the axial direction, that is, in the traveling direction of the sheet. Common rails 35 are slidably supported by a plurality of rail pedestals 34 so that respective protrusions 36 projecting from the common rails 35 abut against lower sides of the middle portions of the respective arms 32 and cause the arms 32 to swing, and thereby the respective press rolls 9 are elevated and lowered.

As shown in FIGS. 1(A) and 1(B), worm wheels 38 supported by brackets 39 on the respective side frames 10 are threadedly engaged with screw rods 37 connected to the end portions of the common rails 35. A worm gear 41 is fixedly fitted around a drive shaft 40 that is rotatably supported between the respective side frames 10. Worm gear 41 is meshed with the worm wheel 38. The common rails 35 are reciprocated via the worms 41, the worm gears 38 and the screw rods 37 by normally or reversely driving the drive shaft 40 via a shaft coupling 44 by means of a geared motor 43 on a bracket 42.

Furthermore, as shown in FIG. 2(A), in contrast to the fact that the respective fulcrum intervals p between the respective fulcrums 31 at the top ends of the respective arms 32 are chosen to be the same length, the respective protrusion intervals between the respective protrusions 36 projected from the respective common rails 35 are varied and set at $(p+\alpha)$, $(p+\beta)$ and $(p+\gamma)$, respectively, so as to establish successively different pitches. In the illustrated embodiment, the variation in the protrusion intervals are repeated for every press roll group consisting of three press rolls. In response to leftward movement, as viewed in FIG. 2(A), of the common rails 35, the press rolls 9''', 9'' and 9' are raised by successively different heights in the enumerated sequence. While in response to rightward movement as viewed in FIG. 2(A), the press rolls are lowered by successively different heights in the sequence of 9', 9'' and 9''', so that the pressing forces can be adjusted by the amount of movement of the common rails 35.

In addition, as shown in FIG. 2(B), an actuator piece 45 is fixedly secured to the common rail 35, and along the route of movement of the actuator piece 45 are disposed limit switches 46A, 46B, 46C and 46D positioned opposite the actuator piece 45. The detection signals issued from the respective limit switches in response to detection of the actuator piece 45 are fed back to the geared motor 43 for drive control (drive or stoppage). Thus, the operation position control for the common rail 35 is effected in such manner that upon actuation of the limit switch 46D all the press rolls are lowered and take operative positions. Further, upon actuation of the limit switch 46A only the press roll 9''' is elevated to an inoperative position, upon actuation of the limit switch 46B the press rolls 9''' and 9'' are elevated to inoperative positions, and upon actuation of the limit switch 46C all the press rolls are elevated to inoperative position. The operation position control of the present invention permits achieving adjustment of the pressing forces generated by the group of press rolls 9', 9'' and 9''' in various ways and in response to various operating conditions such as a sheet manufacturing speed (sheet traveling speed), specifications (materials and thicknesses) of the raw material paper sheets of the corrugated cardboard sheet, types and combinations of flutes of a corrugated cardboard sheet, working environment, etc. Furthermore, the adjustment is varied for each press roll or for each press roll group.

The number of rolls in the above-described roll group is appropriately increased or decreased according to the manufacturing conditions of the corrugated cardboard sheet, and with regard to the position detector means for the common rail 35, besides the limit switches, approach switches, photo-electric tubes or the like are available.

Now explaining the operation of the first preferred embodiment of the present invention having the aforementioned construction, a single-faced corrugated cardboard sheet a applied with starch and a preheated liner b are pulled into the corrugation machine and superposed. In the heating part 10*a*, the superposed sheets a and b are pinched between the upper surfaces of the respective heating boxes on the lower side and the canvas belt 3 on the upper side and conveyed. Subsequently, in the cooling part 10*b*, sheets a and b are pinched between the conveyor belt 5 on the lower side and the canvas belt 3 on the upper side and conveyed thereby. Also, pressing forces are applied thereto by the press rolls 9 via the canvas belt 3. Sheets a and b are heated and joined into a double-faced corrugated cardboard sheet a, b in the heating part 10*a*, and in the cooling part 10*b* they are cooled and subjected to rectification for warps and the like. The corrugated cardboard sheet is then carried out to the next step of the process.

The above-described common rails 35 are reciprocated along the traveling direction of the sheet by the geared motor 43. The respective arms 32 are made to swing by the above-mentioned reciprocating motion, thereby elevating and lowering respective press rolls in the press roll group. Thus, the press rolls 9 are made to be inoperative by being elevated or made to be operative for applying pressing forces by being lowered. The common rails 35 synchronize the swinging of the respective pairs of arms 32 at the respective ends of the respective press rolls 9. The respective press rolls 9 are elevated and lowered as held horizontally and the pressing forces applied to the both sheets a and b by the respective press rolls 9 are equalized along the sheet's width direction, and thereby preventing partial crushing of the flute tip portions.

In addition, by providing a successively different pitch between the respective fulcrum intervals p and the respective protrusion intervals $(p+\alpha)$, $(p+\beta)$ and $(p+\gamma)$, and by controlling the reciprocated position of the common rails 35, the number of press rolls 9 in a press roll group are elevated and lowered to apply pressing forces which can be adjustably increased or decreased, that is, adjustment of the pressing forces can be arbitrarily effected. As a result, joining performance and reliability of the double-faced corrugated cardboard sheet can be improved.

Furthermore, since the respective press rolls 9 are elevated to successively different heights, countermeasures can be quickly and easily achieved for troubles such as damage of the liner or the like, or the work of removing starch dregs stuck onto the heating box 4 as a result of projection of the width ends of the sheet. Hence, in addition to improvements in safety of the aforementioned work, a rate of operation and a productivity of the machine can be enhanced. Also, there exist advantages such as a simplified structure which enables a running cost including maintenance parts, inspections and repairs, to be saved.

Figure 3:
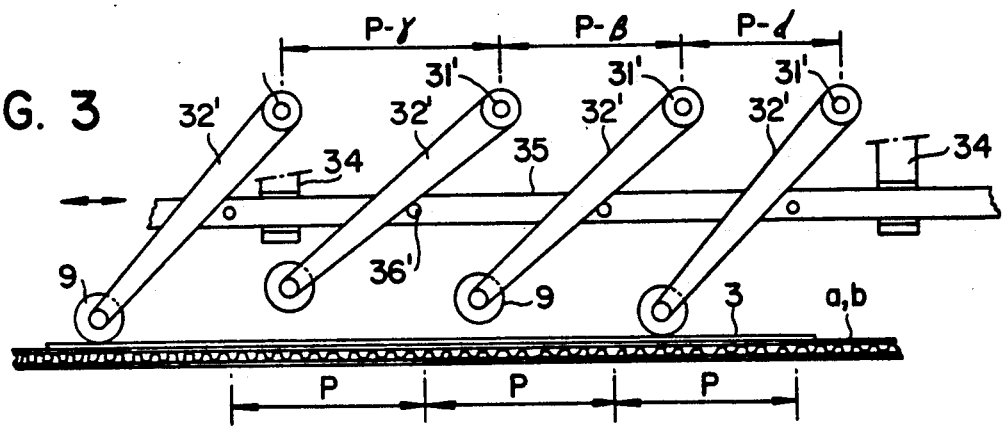
FIG. 3 is an enlarged side view of the portion of a press roll group according to a second preferred embodiment of the present invention.
Figure 4A:
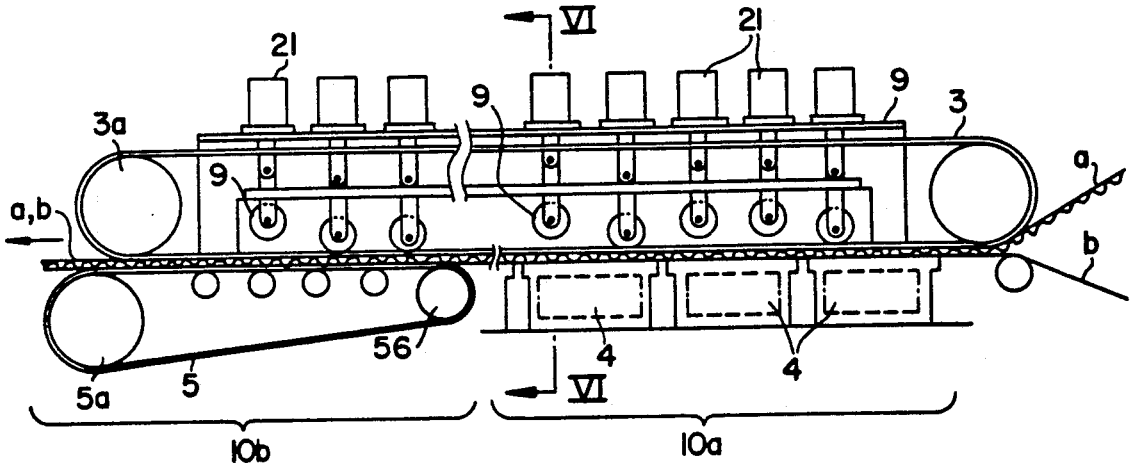
FIG. 4A PRIOR ART
FIG. 4(A) is a side view showing one example of a press roll elevator in the prior art.
Figure 4B:
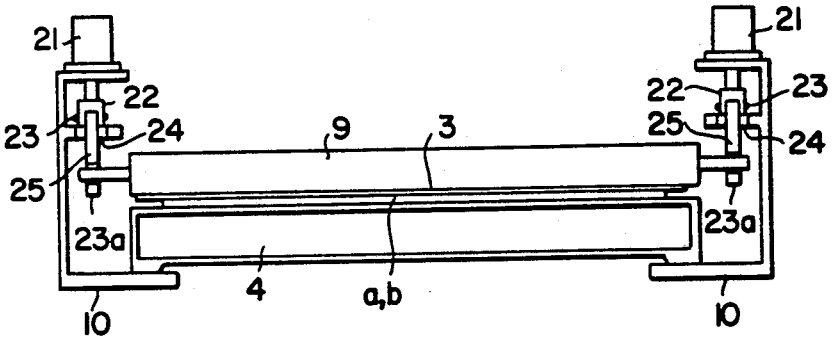
FIG. 4(B) is a cross-section view taken along line IV—IV in FIG. 4(A)
Figure 5A:
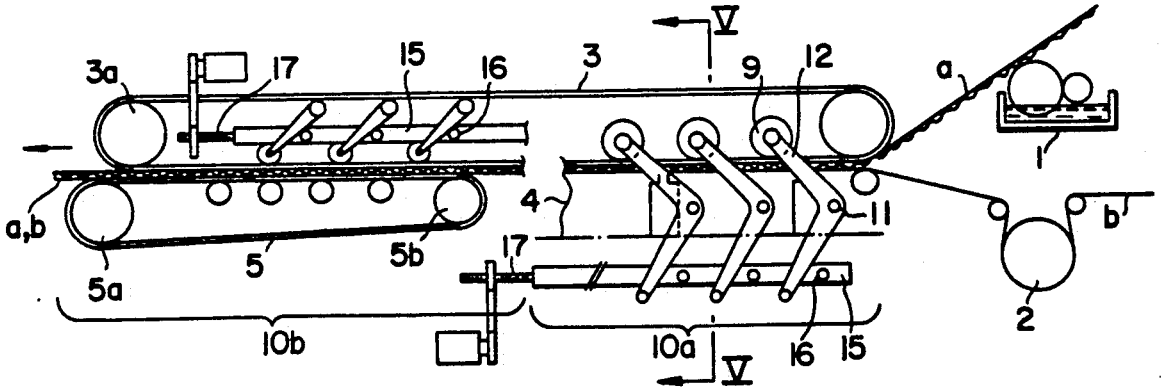
FIG. 5A PRIOR ART
FIG. 5(A) is a side view showing another example of a press roll elevator in the prior art.
Figure 5B:
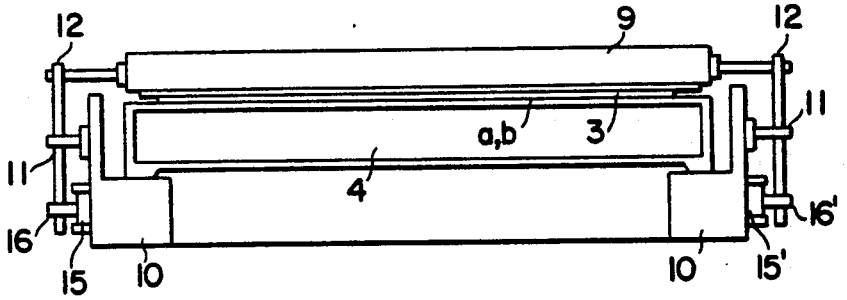
FIG. 5(B) is a cross-section view taken along line V—V in FIG. 5(A).

A second preferred embodiment of the present invention is shown in FIG. 3. As compared to the above-described first preferred embodiment, the second embodiment is characterized in that the respective protrusion intervals between the respective protrusions 36' projected from the common rails 35 are chosen to be the same value p, and the respective fulcrum intervals between the respective fulcrum shafts 31' which pivotably support the upper end portions of the respective arms 32' are relatively varied and set at $(p-\alpha)$, $(p-\beta)$ and $(p-\gamma)$, respectively, establishing successively different pitches along the traveling direction of the sheet. Even with such modified construction, swinging of the respective arms 31' caused by the respective protrusions 36' on the common rails 35 and the elevating and lowering actions thereof for the respective press rolls 9 are substantially the same. As a result, effects and advantages similar to those of the first preferred embodiment can be obtained.

As will be apparent from the detailed description of the invention in connection to preferred embodiments thereof, owing to the above-described characteristic feature of the invention, the respective pairs of arms at the opposite ends of the respective press rolls are made to swing synchronously by the respective protrusions on the common rails reciprocating along the traveling direction of the sheet, hence the respective press rolls are elevated and lowered while maintaining their horizontality, thus the pressing forces applied to the corrugated cardboard sheet by the respective press rolls can be equalized along the widthwise direction of the sheet. As a result, partial crushing of the flute tip portions can be prevented. Also by controlling the reciprocating positions of the common rails, the pressing forces by the press roll group can be adjusted, and a joining performance as well as a reliability are remarkably improved.

In addition, since the respective press rolls are elevated to successively different heights by the common rails, workabilities of counter-measure for troubles such as damage to a liner or the like and removal of starch dregs on the upper surfaces of the heating boxes can be enhanced. Hence, a rate of operation and a productivity are increased as well as obtaining additional advantages such as simplicity in a mechanism and saving of a running cost.

While a principle of the present invention has been described above in connection to preferred embodiments of the invention, it is a matter of course that all matter contained in the specification and illustrated in the accompanying drawings shall be interpreted to be illustrative and not in a limiting sense.

What is claimed is:

1. A press roll elevator in a double facer including press roll groups each having a plurality of press rolls for a corrugated cardboard sheet traveling in a first direction through said double facer, said double facer comprising side frames for supporting respective pairs of arms rotatably mounted about fulcrum shafts which are mounted on said both side frames of said double facer, said fulcrum shafts are mounted on said side frames at fulcrum intervals between said fulcrum shafts in said first direction, said press rolls are rotatably supported between tip end portions of said respective pairs of arms which are constructed to swing about said fulcrum shafts in said first direction, said press rolls are disposed at intervals along the first direction, said press rolls are elevated and lowered by a means for swinging, wherein the swinging means of the press roll elevator comprises common rails and means for reciprocating said common rails along said first direction, said common rails comprising protrusion means disposed along said common rails at protrusion intervals along said first direction for abutting against said respective arms and for swinging said respective arms, and differences in the fulcrum intervals between the fulcrum shafts and the protrusion intervals between the protrusion means disposed along said common rails are successively varied in said first direction.

2. A press roll elevator in a double facer as set forth in claim 1, wherein the fulcrum intervals between the respective fulcrum shafts are chosen to be the same length, and the protrusion intervals between the protrusion means disposed along said common rails are successively varied in said first direction of the sheet.

3. A press roll elevator in a double facer as set forth in claim 1, wherein the protrusion intervals between the protrusion means disposed along said common rails are chosen to be the same length, and the fulcrum intervals between the respective fulcrum shafts are successively varied in said first direction.

* * * * *